US011920456B2

(12) United States Patent
Ichim et al.

(10) Patent No.: US 11,920,456 B2
(45) Date of Patent: Mar. 5, 2024

(54) TUBULAR INSTALLATION MONITORING SYSTEM AND METHOD

(71) Applicant: Tenaris Connections B.V., Amsterdam (NL)

(72) Inventors: Adonis-Costin Ichim, Houston, TX (US); Carlos Hector Blanc, Katy, TX (US); Alexandru Adrian Zestran, Houston, TX (US); Carlos Ignacio Lucca, Houston, TX (US); Lee Jeremy Pereira, Houston, TX (US)

(73) Assignee: Tenaris Connections B.V., Amsterdam (NL)

( * ) Notice: Subject to any disclaimer, the term of this patent is extended or adjusted under 35 U.S.C. 154(b) by 20 days.

(21) Appl. No.: 17/691,750

(22) Filed: Mar. 10, 2022

(65) Prior Publication Data

US 2022/0290552 A1 Sep. 15, 2022

Related U.S. Application Data

(60) Provisional application No. 63/159,298, filed on Mar. 10, 2021.

(51) Int. Cl.

| | |
|---|---|
| ***E21B 47/007*** | (2012.01) |
| ***E21B 7/20*** | (2006.01) |
| ***E21B 43/10*** | (2006.01) |
| ***E21B 47/04*** | (2012.01) |

(52) U.S. Cl.

CPC ..... *E21B 47/007* (2020.05); *E21B 7/20* (2013.01); *E21B 47/04* (2013.01); *E21B 2200/20* (2020.05)

(58) Field of Classification Search

CPC ..... E21B 47/007; E21B 47/04; E21B 43/10; E21B 2200/20

See application file for complete search history.

(56) References Cited

U.S. PATENT DOCUMENTS

| | | | | |
|---|---|---|---|---|
| 2006/0131027 | A1 | 6/2006 | Chiesa et al. | |
| 2007/0284112 | A1 | 12/2007 | Magne et al. | |
| 2009/0308616 | A1 | 12/2009 | Wylie et al. | |
| 2014/0303894 | A1 * | 10/2014 | Abbassian | E21B 47/005 702/6 |
| 2015/0337640 | A1 | 11/2015 | Huang et al. | |

(Continued)

FOREIGN PATENT DOCUMENTS

WO 2019119107 A1 6/2019

OTHER PUBLICATIONS

Ramba et al., A Robust Anomaly Detection Methodology Using Predicted Hookload and Neutral Point for Oil Well Drilling, Online Aug. 26, 2020, Journal of Petroleum Science and Engineering 195, 13 pp. (Year: 2020).*

(Continued)

*Primary Examiner* — Toan M Le
(74) *Attorney, Agent, or Firm* — Bracewell LLP

(57) ABSTRACT

Embodiments of the disclosure include a casing installation monitoring system that monitors surface equipment (that is, equipment of a rig), provides information on casing installation operations (for example, hook load, torque, RPM, and cumulative fatigue) at various times and depths, provides initial casing installation guidelines, and provides alarms before and during the casing installation operation.

23 Claims, 7 Drawing Sheets
(3 of 7 Drawing Sheet(s) Filed in Color)

(56) References Cited

U.S. PATENT DOCUMENTS

2019/0330924 A1 10/2019 Noui-Mehidi

OTHER PUBLICATIONS

International Search Report and Written Opinion for International Application No. PCT/US2022/019791, dated Jun. 3, 2022; pp. 1-17.
American Petroleum Institute; "API Recommended Practice for Drill Stem Design and Operating Limits" API RP 7G, Tenth Edition, Jan. 1981; pp. 1-92.

* cited by examiner

TUBULAR INSTALLATION MONITORING SYSTEM AND METHOD

CROSS-REFERENCE TO RELATED APPLICATIONS

This application claims priority from U.S. Provisional Application No. 63/159,298 filed Mar. 10, 2021, and titled "TUBULAR INSTALLATION MONITORING SYSTEM AND METHOD." For purposes of United States patent practice, this application incorporates the contents of the Provisional Application by reference in its entirety.

BACKGROUND

Field of the Disclosure

The present disclosure generally relates to the access and production of hydrocarbons (for example, oil and gas) from hydrocarbon reservoirs. More specifically, embodiments of the disclosure relate to the installation of tubular components (for example, casing) in wells drilled to access hydrocarbon reservoirs.

Description of the Related Art

Hydrocarbon production typically relies on wells drilled to access hydrocarbon reservoirs, such as reservoirs located in subterranean formations. During completion of a well, tubulars such as casing may be installed to support the well and provide a conduit from a hydrocarbon reservoir to the surface to facilitate production of hydrocarbons via the well. The casing installation process (also referred to as "running casing" or "running pipe") in both horizontal and vertical wells presents various challenges related to the well trajectory, excessive drag in the wellbore, excessive torque, dynamic downhole effects, fatigue, and connection runability.

SUMMARY

Embodiments of the disclosure include a casing installation monitoring system that monitors surface equipment (that is, equipment of a rig), provides information on casing installation operations (for example, hook load, torque, RPM, cumulative fatigue) at various times and depths, provides initial casing installation guidelines, and provides alarms before and during the casing installation operation. Advantageously, the casing installation monitoring system may use various data sources, streamline the planning process, and provide casing installation data, thus reducing time for decisions relating to the casing installation operation and increasing operational efficiency. The system may further determine and provide key performance indicators that may assist in reducing non-productive time (NPT).

In some embodiments, a method for installing a casing in a well is provided. The method includes receiving data associated with a rig, the data including electronic drilling recorder (EDR) data, such that the EDR data including hook load, string depth, revolutions-per-minute (RPM), torque, and block height. The method also includes determining, using the EDR data, a rig state associated with the rig and determining, using the rig state and the EDR data, a cumulative fatigue associated with the casing.

In some embodiments, the method includes installing the casing in the well. In some embodiments, the method includes stopping installation of the casing in the well based on the determination that the cumulative fatigue exceeds a fatigue threshold. In some embodiments, the data associated with the rig includes block weight. In some embodiments, the rig state is selected from the group consisting of running in hole (RIH), reaming in, tripping out of hole (TOOH), backreaming, rotating on and off Bottom (ROB), in slips, making a connection, a static state, and an unknown state. In some embodiments, the method includes activating an alarm based on the EDR data, the cumulative fatigue, or a combination thereof. In some embodiments, the method includes determining, using the EDR data, the rig state, or a combination thereof, casing installation data. In some embodiments, the casing installation data includes a plot of hook load vs depth or a plot of surface torque vs depth. In some embodiments, the method includes providing the casing installation data on an interactive visualization platform on a display.

In another embodiment, a non-transitory computer-readable storage medium having executable code stored thereon for monitoring a casing installation is provided. The executable code includes a set of instructions that causes a processor to perform operations that include receiving data associated with a rig, the data including electronic drilling recorder (EDR) data, such that the EDR data includes hook load, string depth, revolutions-per-minute (RPM), torque, and block height. The operations also include determining, using the EDR data, a rig state associated with the rig and determining, using the rig state and the EDR data, a cumulative fatigue associated with the casing.

In some embodiments, the data associated with the rig includes block weight. In some embodiments, the rig state is selected from the group consisting of running in hole (RIH), reaming in, tripping out of hole (TOOH), backreaming, rotating on and off Bottom (ROB), in slips, making a connection, a static state, and an unknown state. In some embodiments, the method includes activating an alarm based on the EDR data, the cumulative fatigue, or a combination thereof. In some embodiments, the operations include determining, using the EDR data, the rig state, or a combination thereof, casing installation data. In some embodiments, the casing installation data includes a plot of hook load vs depth or a plot of surface torque vs depth. In some embodiments, the operations include providing the casing installation data on an interactive visualization platform on a display.

In another embodiment, a system for monitoring a casing installation is provided. The method includes a processor and non-transitory computer-readable storage memory accessible by the processor and having executable code stored thereon for monitoring a casing installation. The executable code includes a set of instructions that causes the processor to perform operations including receiving data associated with a rig, the data including electronic drilling recorder (EDR) data, such that the EDR data includes hook load, string depth, revolutions-per-minute (RPM), torque, and block height. The operations also include determining, using the EDR data, a rig state associated with the rig and determining, using the rig state and the EDR data, a cumulative fatigue associated with the casing.

In some embodiments, the data associated with the rig includes block weight. In some embodiments, the rig state is selected from the group consisting of running in hole (RIH), reaming in, tripping out of hole (TOOH), backreaming, rotating on and off Bottom (ROB), in slips, making a connection, a static state, and an unknown state. In some embodiments, the method includes activating an alarm based on the EDR data, the cumulative fatigue, or a combination thereof. In some embodiments, the operations include determining, using the EDR data, the rig state, or a combination thereof, casing installation data. In some embodiments, the casing installation data includes a plot of hook load vs depth or a plot of surface torque vs depth. In some embodiments, the system includes a display and the operations include providing the casing installation data on an interactive visualization platform on a display.

BRIEF DESCRIPTION OF THE DRAWINGS

The patent and application file contains at least one drawing executed in color. Copies of this patent or patent application publication with color drawing(s) will be provided by the Office upon request and payment of the necessary fee.

DETAILED DESCRIPTION

Figure 1:
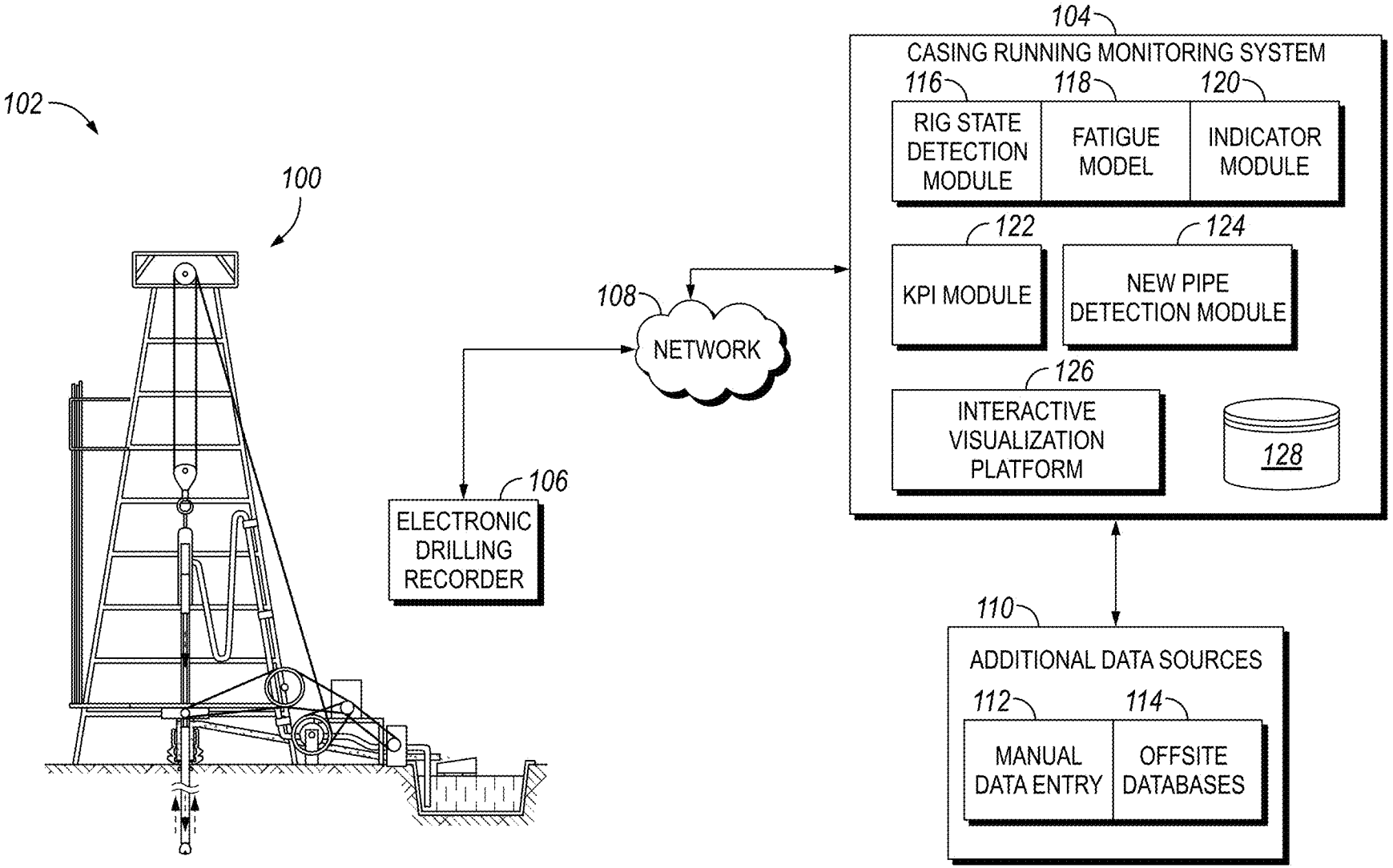
FIG. 1 is a schematic diagram of a surface equipment (for example, a rig) at a wellsite and a casing installation monitoring system in accordance with an embodiment of the disclosure.

The present disclosure will be described more fully with reference to the accompanying drawings, which illustrate embodiments of the disclosure. This disclosure may, however, be embodied in many different forms and should not be construed as limited to the illustrated embodiments. Rather, these embodiments are provided so that this disclosure will be thorough and complete, and will fully convey the scope of the disclosure to those skilled in the art.

Embodiments of the disclosure include systems to monitor and improve the installation of tubular components (for example, casing) in a well. Embodiments of the disclosure also include processes for installing tubular components in a well and monitoring the installation of such tubular components. As described in the disclosure, a tubular installation monitoring system and associated process may receive and process data from surface equipment of a rig at a wellsite and receive additional data from other sources. The tubular installation monitoring system and associated process may 1) provide tubular installation guidelines; 2) determine a state of the rig; 3) provide alarms based on deviations from installation guidelines or other evaluations; 4) determine the cumulative fatigue across a tubular (for example, casing string); 5) determine operational limits for the tubular installation operation; and 6) determine key performance indicators (KPIs) for the tubular installation operation.

Embodiments of the disclosure also include installing a tubular in a well using the guidelines, indicators, or other information provided by the tubular installation monitoring system. Embodiments of the disclosure may further include providing data (for example, guidelines, tubular installation data, alarms, and key performance indicators) in an interactive visualization platform. In some embodiments, the data may be provided in real-time. As used herein, the term "real-time" refers to a sampling rate of at least 10 seconds (0.1 Hz), such that received and processed data has a minimum time interval of 10 seconds. As will be appreciated, the sampling rate may depend on the capabilities provided by an electronic drilling recorder (EDR). In some embodiments, the sampling rate may be 0.1 Hz, 0.2 Hz, or 1 Hz.

Advantageously, embodiments of the disclosure may provide a real-time assessment of the operational limits of a tubular installation operation and improvement of the operation via physics-based modeling, indicators, and fatigue determinations. Moreover, embodiments of the disclosure may increase the speed of installation of tubulars, the speed of tubular connection make-up, reduce the time to perform various operations at the wellsite, and increase operational efficiency. Further embodiments of the disclosure may reduce NPT, minimize or eliminate damage to tubulars or tubular connections, and minimize or eliminate loss of lateral length and production.

As discussed in the disclosure, the initial tubular installation guidelines may include the maximum depth at which casing can be installed without buckling for the analyzed friction factors, and if rotation is allowed based on the given wellbore conditions, string configuration, well trajectory, and may include other installation guidelines. The rig state may include determining if the casing string is moving down, moving up (with or without rotation), if the string is static (with or without rotation), if the string is in slips, or if a connection is being made up on the rig floor. The alarms may provide an alarm on an interactive visualization platform based on, for example, the evaluation of tubular installation data to a threshold. The interactive visualization platform may provide a user with the ability to acknowledge the indicator and take mitigating action. The cumulative fatigue may be determined by using the surface load and rotating parameters at a certain time and string depth, the given wellbore conditions, string configuration, and well trajectory. These parameters are used to compute a number of cycles at certain conditions, which are then compared to laboratory-established full scale testing data (S-N curves) applicable to certain connections at specific stress levels. The key performance indicators (KPIs) for the tubular installation operation may include average, minimum, and maximum installation speed, and average connection make-up time. The key performance indicators may be aggregated at various time intervals and for various entities (for example, per rig, casing string, well, casing installation crew).

The tubular installation monitoring system may detect a tubular to determine when to display datapoints, when to calculate cumulative fatigue, and for determine of key performance indicators. In some embodiments, the number of datapoints may be downsampled for certain determinations and displayed in an interactive visualization platform to show one point per pipe and a set time interval.

It should be appreciated that embodiments of the disclosure may be described with respect to a specific type of tubular, such as casing. However, embodiments may be used with other types of tubulars.

FIG. 1 is a schematic diagram of surface equipment (for example, a rig 100) at a wellsite 102 and a casing installation monitoring system 104 in accordance with an embodiment of the disclosure. The rig 100 may include various components known in the art for drilling and completing a well and providing for the installation of tubulars (for example, casing) in a well. The rig 100 may include or be coupled to an electronic drilling recorder 106 that receives sensor data from components of the rig 100 and transmits such data to an external device or system (for example, the casing installation monitoring system 104), such as via a network 108. In some embodiments, the electronic drilling recorder 106 may provide the following data: hook load, string depth, revolutions-per-minute (RPM), torque, and block height.

In some embodiments, the casing installation monitoring system 104 may obtain data at a rate of every 0.5 seconds, every 1 second (that is, at a 1 Hz frequency), every 5 seconds, or every 10 seconds. In some embodiments, the casing installation monitoring system 104 may obtain data at rate greater than 1 second but less than 60 seconds.

The casing installation monitoring system 104 may also receive data from additional data sources 110. These additional data sources 110 may include manual data entry 112 and offsite database(s) 114. For example, in some embodiments the manual data entry may include block weight, operator information, hook load curves, surface torque curves, and string sections. The offsite database(s) 114 may include databases from casing manufacturers that provide specific casing data, such as pipe body and connection performance parameters, or offsite well lifecycle data management solutions. In some embodiments, hook load and surface torque curves and other applicable outputs may be generated by a physics-based model accessible over a network (for example, a physic-based model accessible via a cloud-computing system).

The casing installation monitoring system 104 may include various modules and may determine and provide casing installation information according to the techniques discussed in the disclosure. As shown in FIG. 1, the casing installation monitoring system 104 may include a rig state determination module 116, a fatigue model 118, an alarms module 120, a KPI module 122, and a new pipe detection module 124. The casing installation monitoring system 104 may include an interaction visualization platform 126 that may be displayed on a display coupled to or a part of the casing installation monitoring system 104. The casing installation monitoring system may also include one or more database(s) 128 that may store, for example, received data from the EDR 106, determined casing installation data, and casing installation guidelines.

Figure 2:
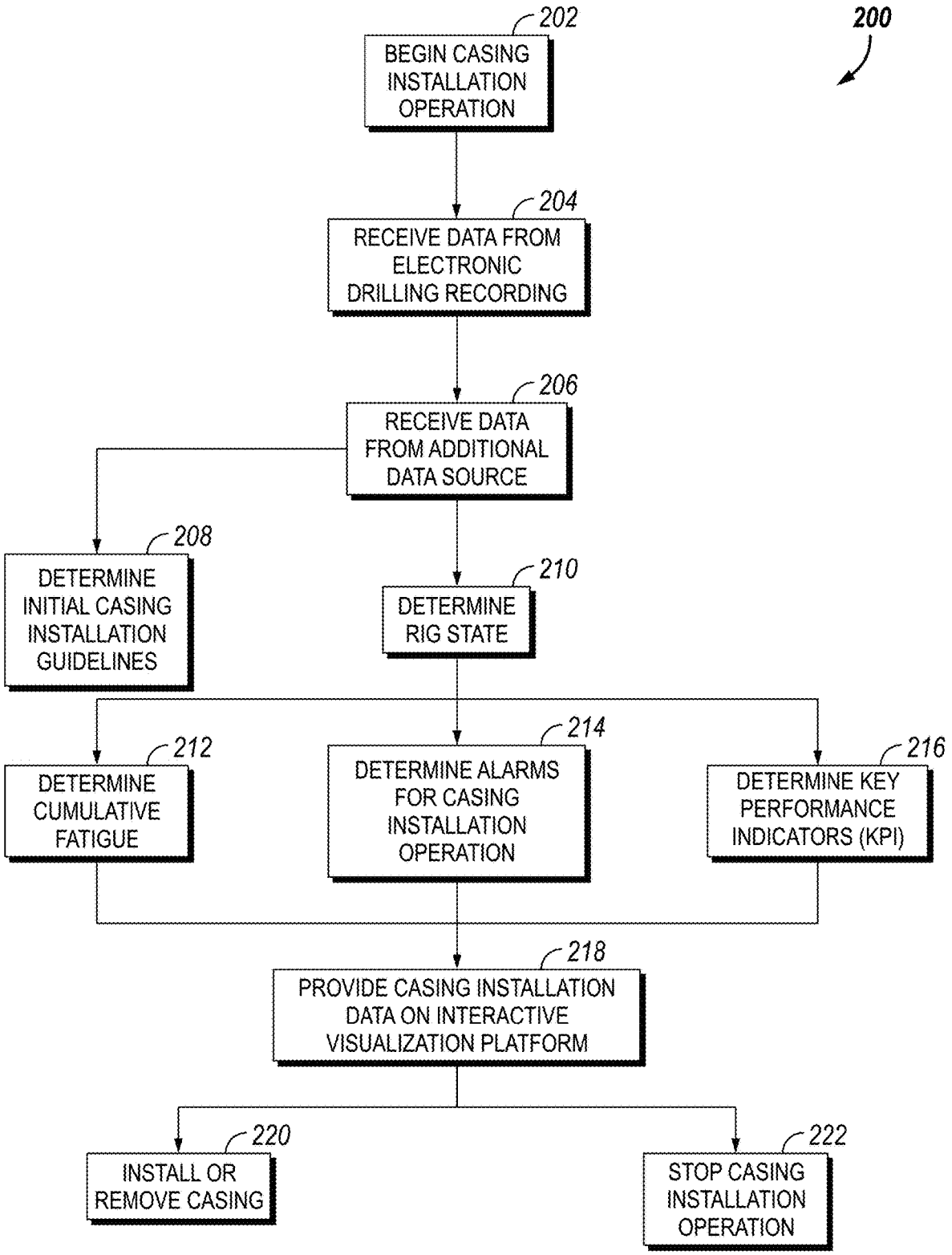
FIG. 2 is a flowchart of a process for installing casing and monitoring a casing installation process in accordance with an embodiment of the disclosure.

FIG. 2 depicts a process 200 for installing casing and monitoring a casing installation process in accordance with an embodiment of the disclosure. Initially, the casing installation operation may begin at a wellsite (block 202). Data may be received from an electronic drilling recorder (EDR) at the wellsite (block 204). In some embodiments, data may be received from the EDR before the casing installation operation begins, as well as during the casing installation operation. Next data may be received from additional data sources (block 206), such as manual data entry, offsite databases, or a combination thereof.

In some embodiments, initial casing installation guidelines may be determined (block 208). In some embodiments, a rig state may be determined (block 210) from the received data. Next, the cumulative fatigue across a casing string may be determined (block 212). Additionally, alarms related to the casing installation operation may be determined (block 214). In some embodiments, key performance indicators for the casing installation operation may be determined (block 216).

As described further in the disclosure, the casing installation data may be provided on an interactive visualization platform of a casing installation monitoring system (block 218). The casing installation data may include, for example, some of the determinations performed by the casing installation monitoring system. In some embodiments, a casing string may be installed or removed based on the one or more of the determinations (block 220). In some embodiments, the casing installation operation may be adjusted or stopped based on the determinations (block 222).

Figure 3:
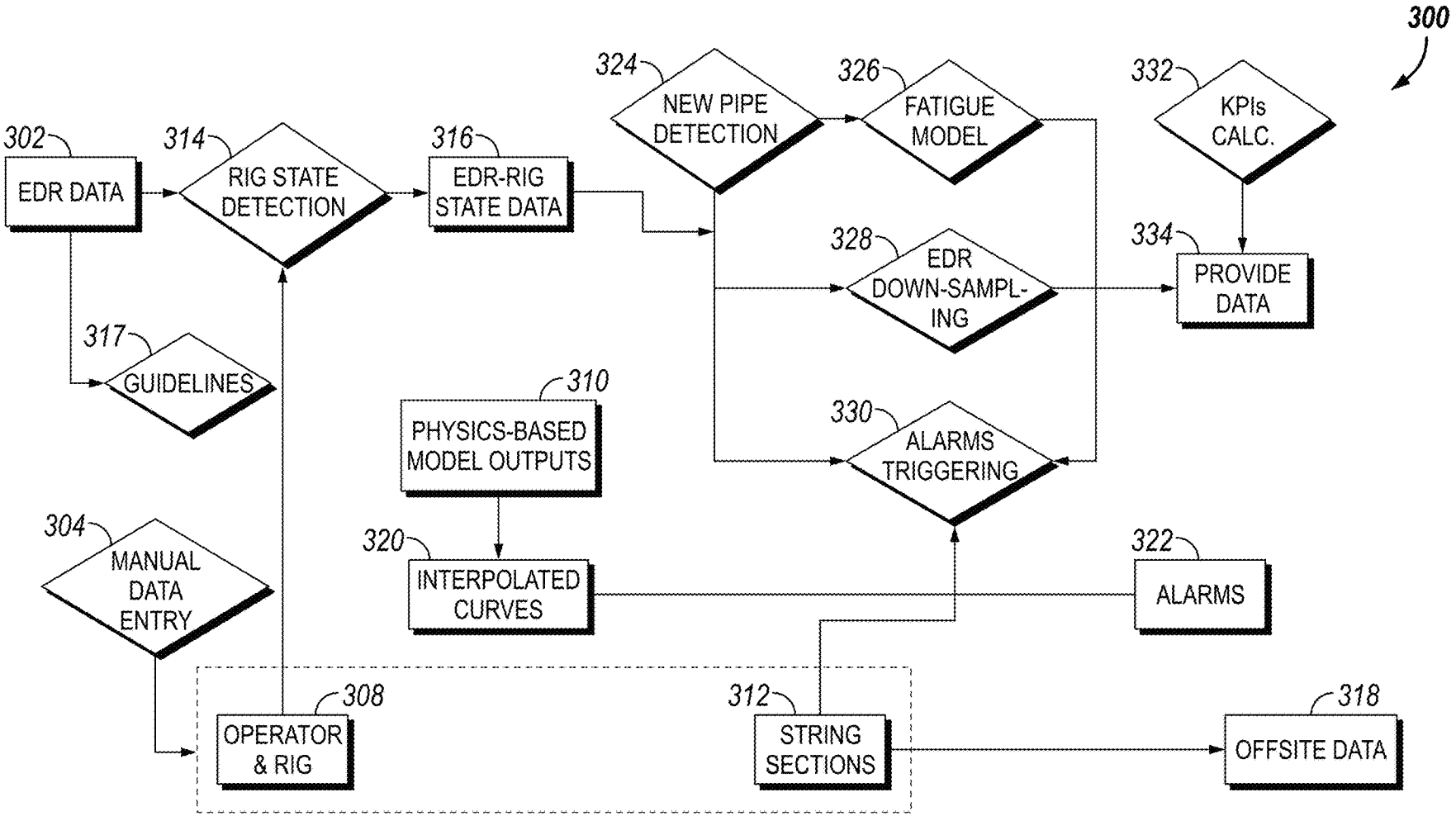
FIG. 3 is a flowchart of the operation of a casing installation monitoring system in accordance with an embodiment of the disclosure.

FIG. 3 depicts a process 300 illustrating operation of a casing installation management system in accordance with an embodiment of the disclosure. Initially, electronic data recorder (EDR) data 302 and entered manual data 304 may be obtained. As shown in FIG. 3, the manual data 304 may include, include, in some embodiments, operator and rig data 308. The operator and rig data 308 may include, for example, block weight. In addition to the manual data entry 304, the process 300 may include receiving offsite data 318. In some embodiments, offsite data 318 may be obtained from a third party provider using an application programming interface (API) provided by the third party provider. The offsite data 318 may include product data from a manufacturer of casing. The offsite data 318 may provide, for example, hook load and surface torque curves 310 (for example, hook load and surface torque curves determined from a physics-based model) and casing string section data 312. Casing installation guidelines 317 may be determined using the EDR data 302 and previous determinations from physics-based models.

As discussed further in the disclosure, a rig state may be determined (block 314) based on the EDR data 302 and the manual data entry 304, such as the operator and rig data 308. The rig state determination 314 may produce EDR-rig state data 316 for use in additional determinations shown in the process. As shown in FIG. 3, in some embodiments, interpolated hook load and surface torque curves 320 may be determined and associated with alarms 322 defined and stored on the casing installation monitoring system.

As also shown in FIG. 3, a connection of new pipe may be determined (block 324) using the EDR-rig state data 316. A fatigue model 326 may receive a determination of new pipe and receive the EDR-rig state data 314 and determine cumulative fatigue. In some embodiments, the process 300 may include downsampling 328 to downsample the EDR-rig state data 314 and reduce the number of datapoints to be plotted in graphs of casing installation data or otherwise processed. Additionally, the process 300 may include triggering alarms 330 based on the EDR-rig state data or other data in the process 300.

The process 300 may also include determining key performance indicators (KPIs) 332. As also shown in FIG. 3, the casing installation data generated via the process 300 may be provided (block 334), such as to a user via the interactive visualization platform. In some embodiments, the provided data may include well design data (for example, well operator, rig, and string sections), casing installation guidelines, hook load (for example, real-time hook load, trends, and buckling), surface torque (for example, real-time and limits), well trajectory (position, depth, and dogleg severity (DLS), alarm logs, risk level (based on alarms risk level), and key performance indicators (state time, lost time, crew performance).

Rig State Determination

The rig state determination 314 may determine the state of a rig at a given point in the received EDR data 302. In some embodiments, the determined rig states may include: Running In Hole (RIH), Reaming In, Tripping Out Of Hole (TOOH), Backreaming (Ream Out), Rotating On/Off Bottom (ROB), In Slips, Making Connection, Static and Unknown. The states are defined as follows:

RIH: The string is moving down without rotation.

Reaming In: The string is moving down with rotation.

TOOH: The string is moving up without rotation.

Backreaming: The string is moving up with rotation (also referred to as "Reaming Out").

Rotating On/Off Bottom: The string is rotating without any axial movement.

In Slips: The string is attached to the slips on the rig floor and the whole string weight is supported by it. The slips support the string while a pipe is either removed or added to the string. In some embodiments, the determination of whether a string is in or out of the slips may be based on a statistical analysis of median and standard deviation values for a given sample size.

Making Connection: The string is in slips and a new pipe is being connected to the string.

Static: There is neither axial movement nor rotation in the string and the string is not in slips.

Unknown: The rig state could not be identified correctly. The process 300 may minimize the time spent on this state.

The EDR data 302 used to determine the rig state may include the following variables: Hook Load, String Depth, RPM, Torque, and Block Height. Additionally, the Block Weight may be received via manual data entry 304 and also used in the determination. The variables are further described as follows:

Hook Load: The total force pulling down on the drilling rig traveling block hook. This total force includes the weight of the string in air and the block weight, reduced by any force that tends to reduce that weight. Some forces that might reduce the weight include friction along the wellbore wall and buoyancy.

String Depth: The current depth reached by the string in the wellbore. The depth may vary from 0 to total depth (TD).

RPM: rotation being applied to the string in revolutions per minute.

Torque: torque force being applied to the string.

Block Height (BH): current height of the travelling block.

Block Weight: weight of rig's travelling block. The block weight may be used to determine a threshold for detecting the "In slips" state. As discussed in the disclosure, in some embodiments the Block Weight may be entered manually (for example, as manual data entry 304).

In some embodiments, the rig state may be determined using a decision tree.

New Pipe Determination

The new pipe determination 324 may receive data and determine whether a new pipe (for example, a new section of casing) was connected to the casing. The new pipe determination 324 may be used by the alarms module and the fatigue model.

In some embodiments, the new pipe detection may determine that a new pipe is connected based on the time spent in slips and changes in string depth.

The connection determination provided by the pipe determination 324 may also include the start and end time of the connection (that is, the "slips to slips") time and the start and the end string depth.

Alarms Module

The alarms triggering 330 may evaluate data at time intervals to determine whether any alarm is triggered. In some embodiments, alarms may be grouped by alarm type depending on the variable they are associated with. In some embodiments, the alarms may include the following: Torque, Hook Load, Fatigue, Hydraulics, or a combination thereof (Comb), and Data.

The alarms triggering 330 may use data from one or more sources to determine alarms. In some embodiments, the alarms triggering 330 may use EDR-rig state data 316, third party data 318, the fatigue model 326, the rig state output from the rig state module 314, or any combination thereof. By way of example, some alarms may be triggered when the string approaches or surpasses certain buckling limits during the casing installation process, or when the torque recorded at surface while the casing string is rotated surpasses the capabilities of the casing connection. Other alarms may be triggered when a certain cumulative fatigue value across the string is reached. In some embodiments, mitigation actions to remediate the problem and increase the chances of successfully installing the casing string are provided together with the alarm warnings.

In some embodiments, each alarm may have an associated risk value. The risk value may be used to determine a risk level for an alarm. In some embodiments, the risk level may be shown in the interactive visual platform using a color indicator.

Fatigue Model

The fatigue model 326 may determine the fatigue of casing installed during a casing installation operation. The fatigue model 326 may receive pre-loaded data and EDR-rig state data 306. For example, initialization of the fatigue model 326 may be performed using preloaded and interpolated data.

The fatigue model 326 may determine fatigue at an interval. In some embodiments, the fatigue model 326 may determine fatigue at the first occurrence of a time interval (for example, every 5 minutes) or an action interval (for example, at installation of a new casing joint).

The fatigue model 326 may receive the following inputs: the casing string properties of length, steel grade, and wall thickness), a real force curve, the previous fatigue profile, and the number of revolutions since the last call to the fatigue model 326. These parameters may be used to compute a number of cycles at certain conditions, which are then compared to laboratory-established full scale testing data (that is, relationships of stress to number of cycles, also referred to as "S-N curves") applicable to certain connections at specific stress levels. The fatigue model 326 outputs the cumulative fatigue value over the entire casing string. The fatigue value may be displayed in a fatigue graph on the interactive visualization platform. The fatigue value may also be provided to the alarms triggering 330.

Downsampling Module

The data downsampling 328 may downsample the EDR-rig state data 316 to increase processing efficiency and enable easier display of graphs (for example, hook load, surface torque, and trajectory) graphs on the interactive visualization platform.

In some embodiments, the downsampling module 328 may downsample the EDR-rig state data 316 to specific depth and time intervals for the relevant rig states.

The downsampling module 328 may only downsample data for the rig states relevant to a particular graph or indicator. For example, for a hook load curve the relevant rig states are RIH, TOOH, Ream In and Ream Out. In another example, for a surface torque curve the relevant rig states are Ream In, Ream Out and ROB. In some embodiments, the resulting downsample is an average of the points grouped by rig state.

Installation Guidelines

The casing installation guidelines 317 (also referred as "initial running guidelines") may provide a summary of orientation and recommendations for a casing installation process. In some embodiments, the initial installation guidelines may include the following: the operator of the rig, the rig, the well, the string, and total length.

In some embodiments, the casing installation guidelines 317 may also include the following: depth where helical buckling may begin if no rotation is applied depending on the friction factor (FF): the string sections, the maximum dogleg severity (DLS) for the string sections, and whether they allow rotation; and general recommendations and considerations.

The casing installation guidelines 317 may be obtained from the databases of the casing installation monitoring system based on the received EDR data 302, manual data entry 304, offsite data 318, or any combination thereof. For example, a particular combination of operator and string may have installation guidelines associated in the database. Similarly, variables describing a string section may be stored in the databases and used to retrieve data for the initial installation guidelines.

Key Performance Indicators

The key performance indicators determination 332 may determine KPIs based on any of the available data in the process 300 or combination thereof. In some embodiments, the KPIs may include the following: spent time on each rig state for each rig; bit depth vs time for a well; crew performance; average joints per hour; max joints in one hour; number of joints in the past hour; and individual connection time for a specified number of connections.

Interactive Visualization Platform

As discussed in the disclosure, embodiments of the casing installation monitoring system may include an interactive visualization platform that may provide visualizations of casing installation data and user interface elements for interacting with the casing installation monitoring system. FIGS. 4-7 depict example screens of an interactive visualization platform in accordance with an embodiment of the disclosure. The interactive visualization platform may be updated at set time intervals to enable real-time visualization and decision making. In some embodiments, the interactive visualization platform may include three dashboards: 1) casing installation guidelines; 2) casing installation data; and 3) key performance indicators.

Figure 4:
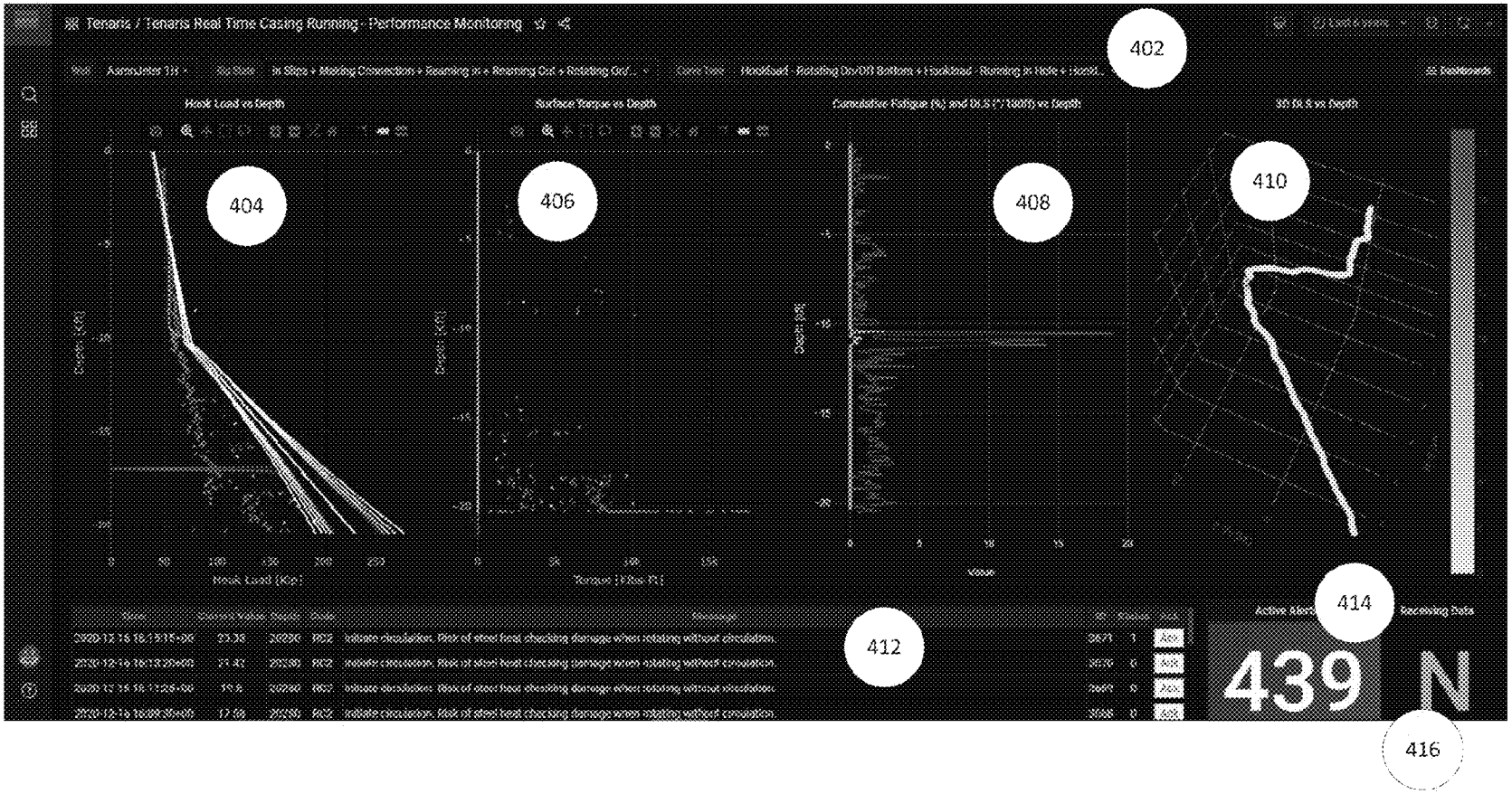
FIGS. 4-6 are screens of an interactive visualization platform of a casing installation monitoring system in accordance with an embodiment of the disclosure.
Figure 5:
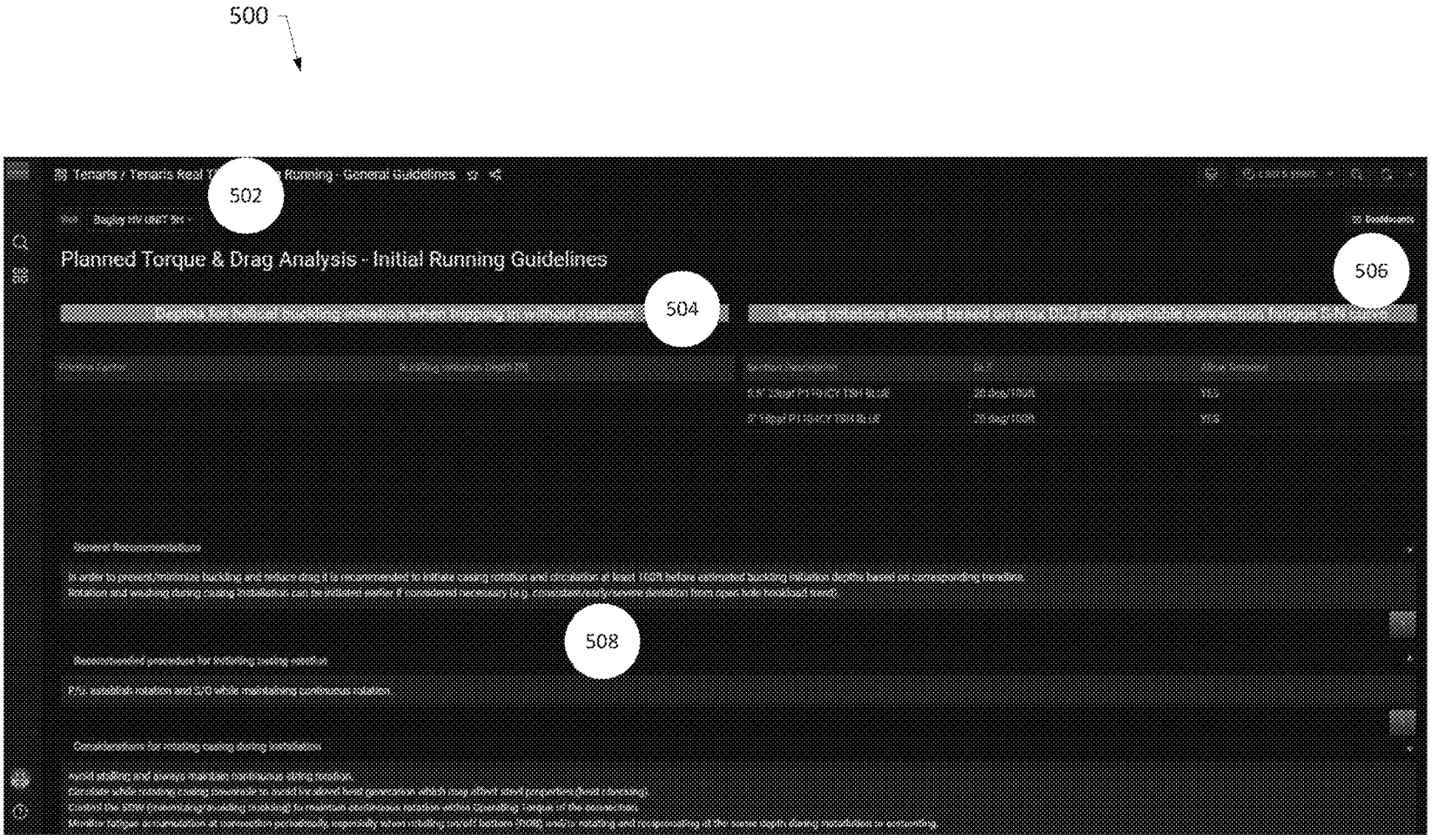

FIGS. 4 and 5 display screens 400 and 500 respectively illustrating casing installation data visualizations. Screen 400 includes graphical elements 402, 404, 406, 408, 410, 412, 414, and 416, as described further below.

Element 402 may include text that includes the well, rig state, and curve type associated with the visual elements 406, 408, and 410. Element 402 may also include user interface elements (for example, dropdown boxes) that enables selection of the well, rig state, and curve type being displayed by the interactive visualization platform.

Element 404 is a hook load graph that is a plot of hook load (in kip) vs depth (in feet (ft)), with the 0 ft depth on top and maximum depth on bottom of the graph. As used herein, the term "kip" equals 1000 pounds-force (lbf) or 4488.2216 Newtons (N). In some embodiments, the element 404 may include recorded hook load vs. depth points having different colors according to the rig state at that point. In some embodiments, the element 404 may include trending curves that depict possible hook load trending lines according to different. In some embodiments, the element 404 may include bucking limits.

Element 406 is a surface torque graph that is a plot of surface torque (in kip) vs depth (in ft), with the 0 ft depth on top and maximum depth on bottom of the graph. In some embodiments, the element 406 may include recorded surface torque vs depth points that may have different colors according to the type of rotating operation performed. In some embodiments, the element 406 may include torque limits indicated by lines representing the torque limits according to different FFs.

The element 408 is a graph that plots cumulated fatigue (in %) vs depth (in ft) and plots DLS (degrees/100 ft) vs. depth (in ft), with the 0 ft depth on top and maximum depth on bottom of the graph.

The element 410 is three-dimensional graph that plots the well trajectory in three dimensions of NS (in ft), EW (in ft) and depth (in ft), with the 0 ft depth on top and maximum depth on bottom of the graph. In some embodiments, a plotted line in the element 410 may have a color gradient based on the DLS at each point of the well trajectory.

As will be appreciated, each of the graphs in elements 406, 408, 410, and 412 may be synchronized when a particular element is selected (such as by moving a cursor over the element, clicking on the element, etc.).

The element 412 is a message log that shows a running log of messages (triggered alarms) by the casing installation monitoring system. In some embodiments, a triggered alarm exceeding a specific risk level may be shown in a pop-up element (for example, pop-up window) on the interactive visualization platform.

Elements 414 and 416 may be status indicators that indicate the status of the casing installation monitoring system. For example, element 414 may provide an indication of the number of active alerts, and element 416 may indicate whether the casing installation system is currently receiving data from a drilling rig (for example, from an electronic drilling recorder).

FIG. 5 illustrates a screen 500 having a display of initial casing installation guidelines in accordance with an embodiment of the disclosure. Screen 500 includes graphical elements 502, 504, 506, and 508, as described further below. Element 502 may include text that identifies the well associated with the visual elements 504, 506, and 508. Element 502 may include a user interface element (for example, a dropdown box) that enables selection of the well being displayed by the interactive visualization platform.

Elements 504, 506, and 508 may provide casing installation guidelines as discussed in the disclosure. For example, the element 504 may indicate the depth at which helical bucking will start if no rotation is applied depending on the FF. The element 506 may indicate the casing string sections, the maximum DLS for each section, and whether they allow rotation. The element 508 may include text that provides recommendations and considerations for the casing installation operation.

Figure 6:
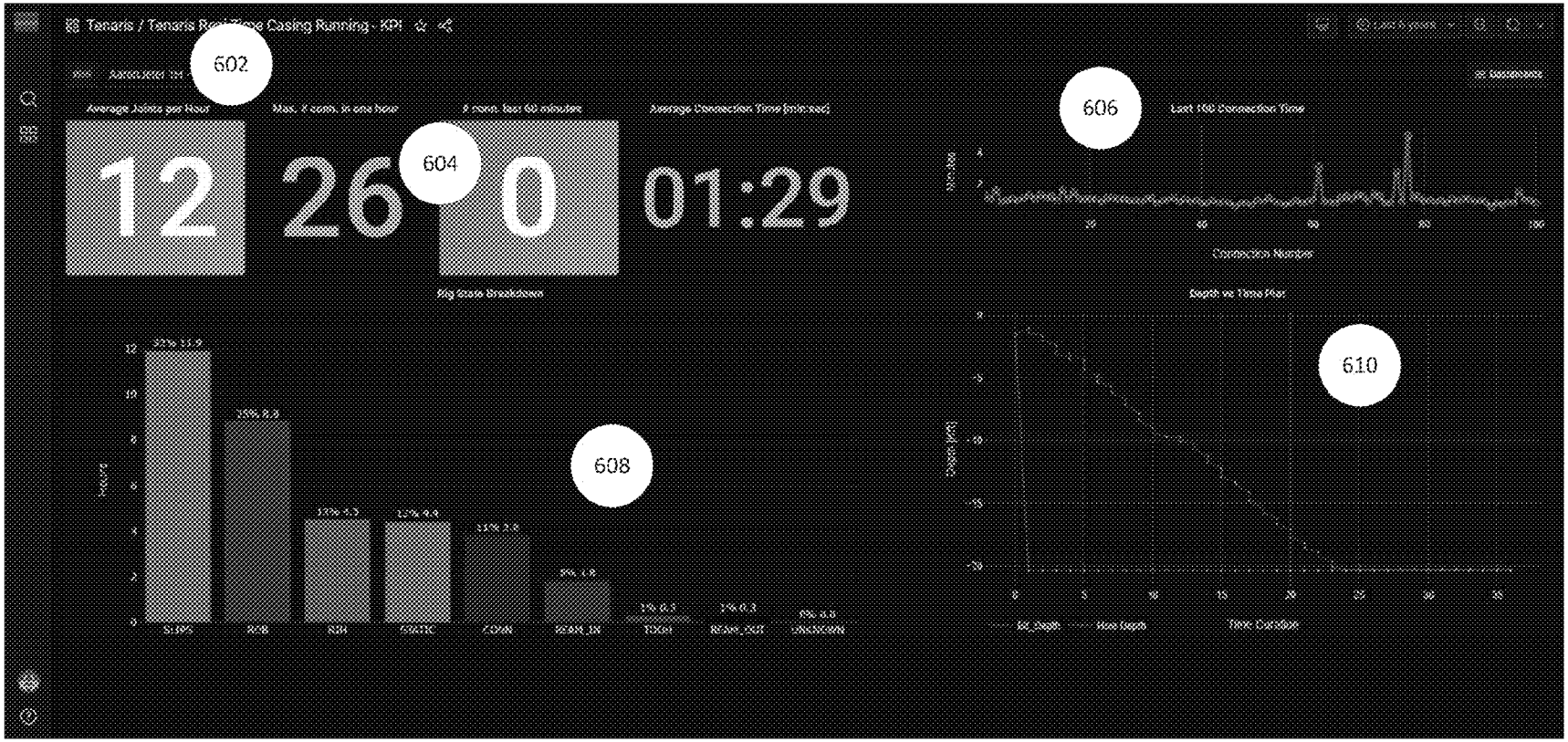

FIG. 6 illustrates a screen 600 having a display of key performance indicators in accordance with an embodiment of the disclosure. The screen 600 may include elements 602, 604, 606, 608, and 610, as described further below.

The element 600 may include text that identifies the well associated with the displayed KPI's. Element 602 may include a user interface element (for example, a dropdown box) that enables selection of the well associated with the displayed KPI's. As shown in FIG. 6, the element 604 may provide KPIs related to Average Joints per Hour, Max # of Connections in one hour, the # of Connections in the last 60 minutes, and the Average Connection Time. The element 606 may show a running plot of the last connection times for the last 100 Connections.

As also shown in FIG. 6, the element 608 may display KPIs for the spent time on each rig state, such as SLIPS, ROB, RIH, etc. The element 610 may display a depth vs. time plot for the selected well and may depict bit depth and hole depth.

Figure 7:
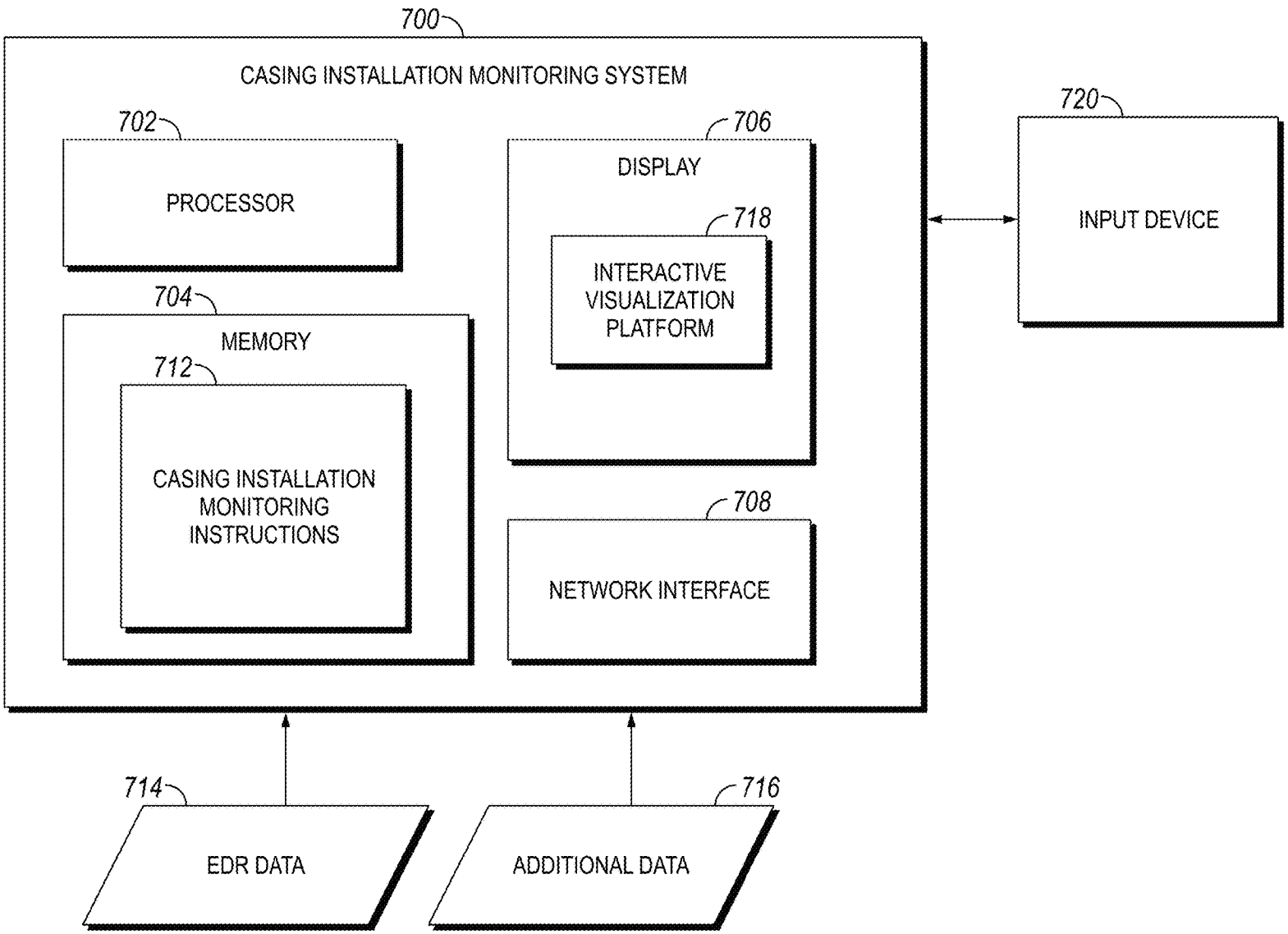
FIG. 7 is a block diagram of a casing installation monitoring system in accordance with an embodiment of the disclosure.

FIG. 7 depicts components of a casing installation monitoring system 700 in accordance with an embodiment of the disclosure. In some embodiments, casing installation monitoring system 700 may be in communication with other components for obtaining data from a rig or providing data to another system. Such other components may include, for example, an electronic drilling recorder as discussed herein. As shown in FIG. 7, the casing installation monitoring system 700 may include a processor 702, a memory 704, a display 706, and a network interface 708. It should be appreciated that the casing installation monitoring system 700 may include other components that are omitted for clarity. In some embodiments, casing installation monitoring system 700 may include or be a part of a computer cluster, cloud-computing system, a data center, a server rack or other server enclosure, a server, a virtual server, a desktop computer, a laptop computer, a tablet computer, or the like.

The processor 702 (as used the disclosure, the term "processor" encompasses microprocessors) may include one or more processors having the capability to receive and process data, such as data an electronic drilling recorder (EDR). In some embodiments, the processor 702 may include an application-specific integrated circuit (AISC). In some embodiments, the processor 702 may include a reduced instruction set (RISC) processor or a complex instruction set (CISC) processor. Additionally, the processor 702 may include a single-core processors and multicore processors and may include graphics processors. Multiple processors may be employed to provide for parallel or sequential execution of one or more of the techniques described in the disclosure. The processor 702 may receive instructions and data from a memory (for example, memory 704).

The memory 704 (which may include one or more tangible non-transitory computer readable storage mediums) may include volatile memory, such as random access memory (RAM), and non-volatile memory, such as ROM, flash memory, a hard drive, any other suitable optical, magnetic, or solid-state storage medium, or a combination thereof. The memory 704 may be accessible by the processor 702. The memory 704 may store executable computer code. The executable computer code may include computer program instructions for implementing one or more techniques described in the disclosure. For example, the executable computer code may include casing installation monitoring instructions 712 that define the various modules and processes to implement embodiments of the present disclosure. In some embodiments, the casing installation monitoring instructions 712 may implement one or more elements of processes 200 and 300 described above and illustrated in FIGS. 2 and 3. In some embodiments, the casing installation monitoring instructions 712 may receive, as input, EDR data 714 and additional data 716, as described in the disclosure. The casing installation monitoring instructions 712 may also provide an interactive visualization platform 716 stored in the memory 704 and, as shown in FIG. 7, displayed on the display 706. The outputs from the casing installation monitoring instructions 712 (for example, as shown in the screens depicted in FIGS. 4-6) may be provided on the interactive visualization platform 716.

The display 706 may include a cathode ray tube (CRT) display, liquid crystal display (LCD), an organic light emitting diode (OLED) display, or other suitable display. The display 706 may display a user interface (for example, a graphical user interface) that may display information received from the plant information processing computer 706. In accordance with some embodiments, the display 706 may be a touch screen and may include or be provided with touch sensitive elements through which a user may interact with the user interface. The display 706 may display the interactive visualization platform 718 produced using the instructions 712 in accordance with the techniques described herein. For example, the interactive visualization platform 718 may display the cumulative fatigue of a casing string, the hook load curve, and the surface torque curve, as described in the disclosure.

The network interface 708 may provide for communication between the casing installation monitoring system 700 and other devices. The network interface 708 may include a wired network interface card (NIC), a wireless (e.g., radio frequency) network interface card, or combination thereof. The network interface 708 may include circuitry for receiving and sending signals to and from communications networks, such as an antenna system, an RF transceiver, an amplifier, a tuner, an oscillator, a digital signal processor, and so forth. The network interface 708 may communicate with networks, such as the Internet, an intranet, a wide area network (WAN), a local area network (LAN), a metropolitan area network (MAN) or other networks. Communication over networks may use suitable standards, protocols, and technologies, such as Ethernet Bluetooth, Wireless Fidelity (Wi-Fi) (e.g., IEEE 802.11 standards), and other standards, protocols, and technologies. In some embodiments, for example, data from an electronic drilling recorder (EDR) may be received over a network via the network interface 708. In some embodiments, for example, outputs from the casing installation monitoring system 700 may be provided to other devices over the network via the network interface 708.

In some embodiments, the casing installation monitoring system 700 may be coupled to an input device 720 (for example, one or more input devices). The input devices 720 may include, for example, a keyboard, a mouse, a microphone, or other input devices. In some embodiments, the input device 720 may enable interaction with a user interface displayed on the display 706. For example, in some embodiments, the input devices 720 may enable the entry of inputs that control the acquisition of data, the processing of casing installation data, acknowledgement of alarms, and so on.

Ranges may be expressed in the disclosure as from about one particular value, to about another particular value, or both. When such a range is expressed, it is to be understood that another embodiment is from the one particular value, to the other particular value, or both, along with all combinations within said range.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used in the disclosure are for organizational purposes only and are not meant to be used to limit the scope of the description.

What is claimed is:

1. A method for installing a casing in a well, comprising:

receiving data associated with a rig, the data comprising electronic drilling recorder (EDR) data, wherein the EDR data comprises hook load, string depth, revolutions-per-minute (RPM), torque, and block height;

determining, using the EDR data, a rig state associated with the rig; and determining, using the rig state and the EDR data, a cumulative fatigue associated with the casing.

2. The method of claim 1, comprising installing the casing in the well.

3. The method of claim 1, comprising stopping or modifying installation of the casing in the well based on the determination that the cumulative fatigue exceeds a fatigue threshold.

4. The method of claim 1, wherein the data associated with the rig comprises block weight.

5. The method of claim 1, wherein the rig state is selected from the group consisting of running in hole (RIH), reaming in, tripping out of hole (TOOH), backreaming, rotating on and off Bottom (ROB), in slips, making a connection, a static state, and an unknown state.

6. The method of claim 1, comprising activating an alarm based on the EDR data, the cumulative fatigue, or a combination thereof.

7. The method of claim 1, comprising determining, using the EDR data, the rig state, or a combination thereof, casing installation data.

8. The method of claim 7, wherein the casing installation data comprises a plot of hook load vs depth or a plot of surface torque vs depth.

9. The method of claim 7, comprising providing the casing installation data on an interactive visualization platform on a display.

10. A non-transitory computer-readable storage medium having executable code stored thereon for monitoring a casing installation, the executable code comprising a set of instructions that causes a processor to perform operations comprising:

receiving data associated with a rig, the data comprising electronic drilling recorder (EDR) data, wherein the EDR data comprises hook load, string depth, revolutions-per-minute (RPM), torque, and block height;

determining, using the EDR data, a rig state associated with the rig;

determining, using the rig state, a cumulative fatigue associated with the casing.

11. The non-transitory computer-readable storage medium of claim 10, wherein the data associated with the rig comprises block weight.

12. The non-transitory computer-readable storage medium of claim 10, wherein the rig state is selected from the group consisting of running in hole (RIH), reaming in, tripping out of hole (TOOH), backreaming, rotating on and off Bottom (ROB), in slips, making a connection, a static state, and an unknown state.

13. The non-transitory computer-readable storage medium of claim 10, the operations comprising activating an alarm based on the EDR data, the cumulative fatigue, or a combination thereof.

14. The non-transitory computer-readable storage medium of claim 10, the operations comprising determining, using the EDR data, the rig state, or a combination thereof, casing installation data.

15. The non-transitory computer-readable storage medium of claim 14, wherein the casing installation data comprises a plot of hook load vs depth or a plot of surface torque vs depth.

16. The non-transitory computer-readable storage medium of claim 15, comprising providing the casing installation data on an interactive visualization platform on a display.

17. A system for monitoring a casing installation, comprising:

a processor;

non-transitory computer-readable storage memory accessible by the processor and having executable code stored thereon for monitoring a casing installation, the executable code comprising a set of instructions that causes the processor to perform operations comprising:

receiving data associated with a rig, the data comprising electronic drilling recorder (EDR) data, wherein the EDR data comprises hook load, string depth, revolutions-per-minute (RPM), torque, and block height;

determining, using the EDR data, a rig state associated with the rig; and determining, using the rig state, a cumulative fatigue associated with the casing.

18. The system of claim 17, wherein the data associated with the rig comprises block weight.

19. The system of claim 17, wherein the rig state is selected from the group consisting of running in hole (RIH), reaming in, tripping out of hole (TOOH), backreaming, rotating on and off Bottom (ROB), in slips, making a connection, a static state, and an unknown state.

20. The system of claim 17, the operations comprising activating an alarm based on the EDR data, the cumulative fatigue, or a combination thereof.

21. The system of claim 17, the operations comprising determining, using the EDR data, the rig state, or a combination thereof, casing installation data.

22. The system of claim 21, wherein the casing installation data comprises a plot of hook load vs depth or a plot of surface torque vs depth.

23. The system of claim 21, comprising a display, wherein the operations comprise providing the casing installation data in an interactive visualization platform on the display.

* * * * *